US008418756B2

(12) United States Patent
Brække

(10) Patent No.: US 8,418,756 B2
(45) Date of Patent: Apr. 16, 2013

(54) WELL PLUG

(75) Inventor: Kristoffer Brække, Stavanger (NO)

(73) Assignee: I-TEC AS, Royneberg (NO)

( * ) Notice: Subject to any disclaimer, the term of this patent is extended or adjusted under 35 U.S.C. 154(b) by 311 days.

(21) Appl. No.: 12/922,985

(22) PCT Filed: Mar. 19, 2009

(86) PCT No.: PCT/NO2009/000105

§ 371 (c)(1),
(2), (4) Date: Nov. 1, 2010

(87) PCT Pub. No.: WO2009/116875

PCT Pub. Date: Sep. 24, 2009

(65) Prior Publication Data

US 2011/0036562 A1 Feb. 17, 2011

(30) Foreign Application Priority Data

Mar. 19, 2008 (NO) ..... 20081406

(51) Int. Cl.
*E21B 33/129* (2006.01)

(52) U.S. Cl.
USPC ..... 166/135; 166/192

(58) Field of Classification Search ..... 166/386, 166/387, 135, 192, 332.3, 334.2
See application file for complete search history.

(56) References Cited

U.S. PATENT DOCUMENTS

| | | | |
|---|---|---|---|
| 2,399,466 | A | 4/1946 | Carlson et al. |
| 3,398,928 | A | 8/1968 | Fredd |
| 4,421,171 | A | 12/1983 | Haynes |
| 4,458,751 | A | 7/1984 | Haynes |
| 4,967,844 | A | 11/1990 | Brooks et al. |
| 5,492,173 | A | 2/1996 | Kilgore et al. |

FOREIGN PATENT DOCUMENTS

| | | |
|---|---|---|
| GB | 2 044 825 | 10/1980 |
| SU | 1609960 | * 11/1990 |

OTHER PUBLICATIONS

International Search Report issued Jul. 17, 2009 in corresponding International Application No. PCT/NO2009/000105.

* cited by examiner

*Primary Examiner* — William P Neuder
(74) *Attorney, Agent, or Firm* — Wenderoth, Lind & Ponack, L.L.P.

(57) ABSTRACT

A well plug having a flexible expandable sealing (330) and a metallic anchor (350) which can be moved radially out or in by rotating a leadscrew (170) in opposite directions. The well plug has a ball valve in a central longitudinal passage, which is kept open whenever the leadscrew (160) rotates. This increases the accuracy when setting the plug, and reduces the risk for the plug moving uncontrolled in the well bore during setting or retrieval. The ball valve can be opened or closed by rotating a transmitting shaft (120, 140) within an angle of free motion, before the leadscrew is pulled along in the rotation. A ball valve for high pressure applications is also shown.

10 Claims, 5 Drawing Sheets

WELL PLUG

This invention concerns a well plug for repeated displacement and ball valve for use in the well plug During recovery of oil and gas, a bore hole is drilled through geological formations. Part of the bore hole is completed with a steel pipe, in the following called the casing, which is cemented to the formation. Production pipes and other equipment can at a later time be introduced down into the wellbore through the casing.

The fluid flowing from the geological formations during recovery, is a mixture of hydrocarbons, mainly gas and/or oil, water, mud, sand, abrasion material and other solid material. The solid material in the mixture is collectively referred to as "debris".

Sometimes it is necessary to plug a wellbore, e.g. in the period between casing and production, for pressure testing and inspection, when a plug is used for isolation/separation of different well fluids like oil, condensate, gas or water, or when the fluid flow from the wellbore no longer contains a sufficient concentration of hydrocarbons.

U.S. Pat. No. 2,399,466 (Steward) describes a plug, which by means of an electromotor and a reduction gear in a running tool rotates a nut about a leadscrew, whereby the plug is contracted axially along its longitudinal axis, and displaces an elastic packer element and metallic anchors, also called slips, radially against a surrounding pipe or casing with sufficient force to seal the pipe. The running tool can then be extracted from the wellbore, and optionally inserted to remove the plug at a later time. This is done by rotating the nut in the opposite direction from the direction used when setting the plug.

U.S. Pat. No. 5,492,173 (Kilgore et al) discloses a similar tool, where a running tool comprising a motor rotates a leadscrew in a nut, whereby a sealing is expanded. This patent also shows use of a battery pack to power the motor.

A problem with well plugs of this and similar types from prior art, where a sealing and a gripping element are moved radially, arises when the sealing engages the wall of the casing before the gripping element. If a pressure difference over the plug arises when the packer seals against the casing, but before the gripping elements have a sufficient hold in the casing, the plug may move unintentionally. in the casing. At best, only the positioning of the plug in the casing is affected. At worst, the plug may cause substantial damage when such pressure differences or pressure shocks arises in the fluid column. Such pressure shocks may cause differential pressures of 100 bar or more over the plug.

A similar problem can arise during retrieval of a plug, because the expandable sealing may need time to resume its original form, and hence may seal against the casing after the anchor is released.

A special case is emergency retrieval, in which a fishing tool is sent into the well to remove the plug. Fishing tools and well plugs are conventionally adapted to each other, so that the fishing tool by providing a blow or other forceful mechanical action breaks shear pins or the like. When this happens, the anchor mechanism is released, and the force pressing the anchor to the surrounding casing is removed. Again, the expandable sealing may need time to resume its original form, and hence may seals against the casing after the anchor is released.

When a ball valve is placed in the plug to provide pressure communication between the two ends of the plug to achieve a precise positioning and avoid the problems above, the ball valve must provide sufficient sealing against flow of gas or liquid, also at differential pressures in the order of 100 bars.

It is also an object of the invention to provide a robust well plug and ball valve having a least possible probability for clogging when conducting a mixture of oil, gas, condensate, water and debris.

These problems are solved by a well plug and a ball valve according to the appended claims.

An advantage of the invention is that the ball valve opens automatically by purely mechanical means when the well plug is moved. This ensures precise repositioning in that differential pressure cannot move the plug when the expandable sealing element is sealing and before the anchor have been supplied with a sufficient radial force towards the casing. The valve can thereafter be closed. These operations may be repeated. Whenever there is a need to move the plug, e.g. between a series of measurements, the plug may thereby be moved and repositioned precisely in the casing without it having to be moved to the surface between each measurement. This saves time and money.

Another advantage of the present invention is that it provides a robust ball valve having few movable parts, which, in its closed position seals better at high differential pressures regardless of which side is subject to the higher pressure. Thereby, the plug having a ball valve, can replace existing plugs.

A further advantage of the ball valve and well plug according to the invention is that they together provide a straight paasage along the main axis of the well-plug when the ball valve is open, so that clogging in narrow passages and annular spaces is avoided.

Yet another advantage of the invention is that the ball valve is opened mechanically and automatically if the plug must be pulled out by a fishing tool, so-called emergency retrieval.

Different embodiments of the invention will be described in the following with reference to the drawings, in which.

Figure 5:
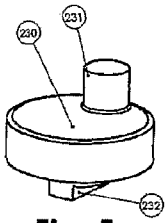
Figure 4B:
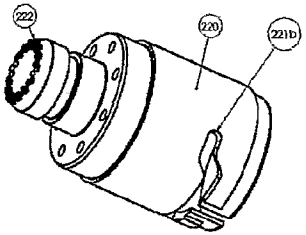
Figure 4A:
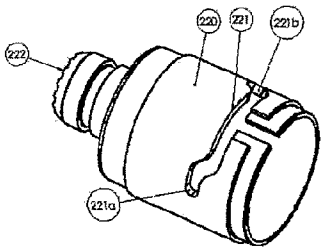
Figure 6:
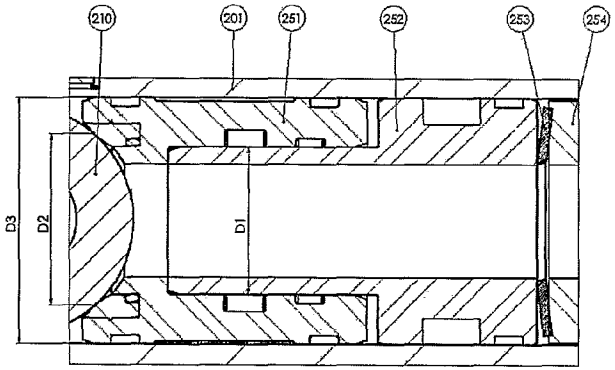

FIGS. 4*a* and 4*b* are perspective views of the activating sleeve of the ball valve;

FIG. 5 is a perspective view of an activating member for the ball valve,

FIG. 6 shows a piston element of the ball valve in greater detail.

Figure 7:
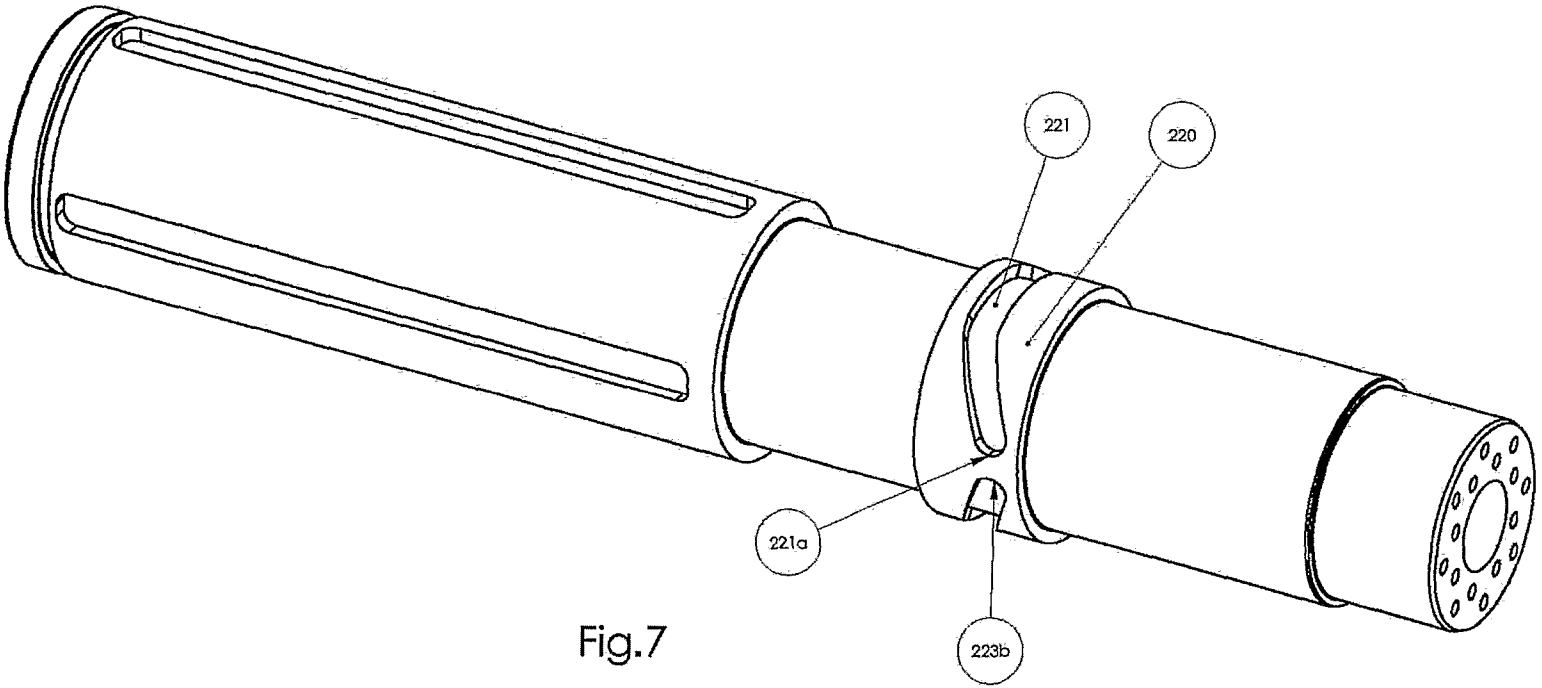
Figure 8:
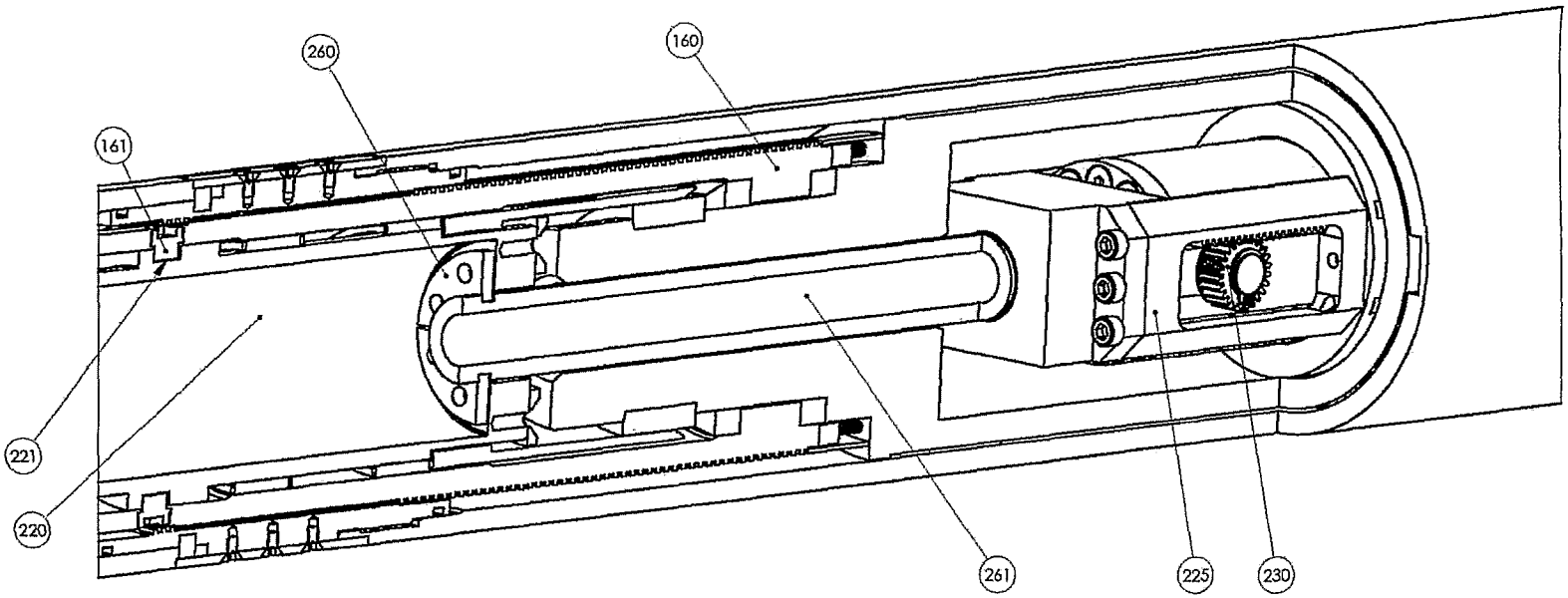
Figure 9:
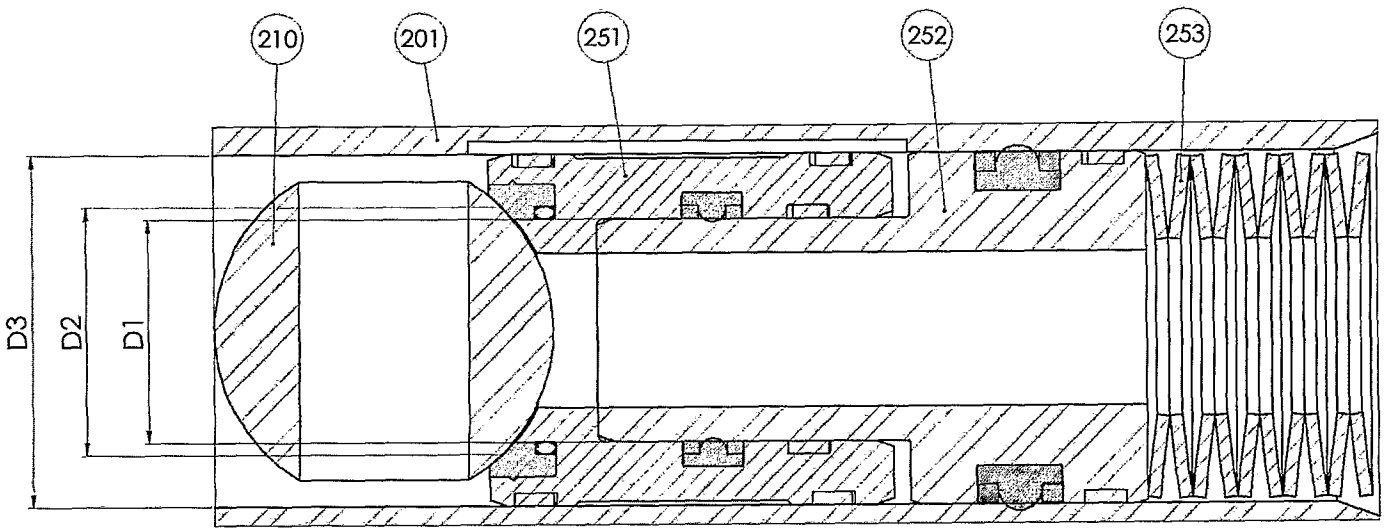

FIG. 7 shows a second embodiment of an activating sleeve,

FIG. 8 is a perspective view of a second embodiment of the valve operating mechanism, and FIG. 9 is the valve of FIG. 6 with seals and bearings better shown.

Figure 1:
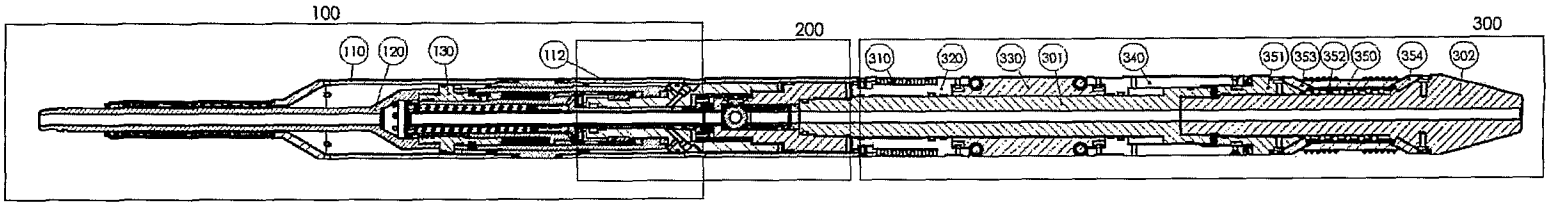
FIG. 1 shows a well plug having a through passage, in which a ball valve according to the invention is shown in a closed position.

FIG. 1 shows a well plug according to the invention. The well plug is rotational symmetric about a main axis, and has a straight passage along this main axis though the entire plug. The well plug comprises an upper end having a force transmitting section 100 having, among other parts, a rotatable, externally threaded leadscrew 160 in threaded engagement with a non-rotating internally threaded leadscrew nut 170 forming a part of the outer shell of the well plug. The force transmitting section is further described with reference to FIG. 2 below.

The well plug further comprises a valve section 200 showing a ball valve according to the invention in a closing position. The valve section 200 is further described with reference to FIG. 3 below.

The well-plug further comprises a packer section 300 in a lower end.

When the leadscrew is rotated in a first direction, the leadscrew nut 170 is moved axially together with an outer shell 110, 112 down towards a flexible sealing element 330 and a metallic anchor 350. The sealing element 330 is thereby contracted, and forced against a surrounding wall of the casing. The anchor 350 is slidably mounted on radially extending inclined surfaces on slide bearings 353, 354, which, when pulled axially towards each other, forces the anchor against the surrounding wall of the casing. The anchor 350 is provided with studs or teeth for a best possible hold on the wall of the casing.

When the leadscrew is rotated in a second direction, opposite the first direction, the leadscrew nut 170 is moved axially together with the outer shell 110, 112 up from the sealing element 330 and anchor 350. The sealing element is thereby pulled away from the wall of the casing. A spring package 352 forces the slide bearings axially away from each other, and thereby pulls the anchor radially in from the wall of the casing.

The sealing element 330 is disposed around a mandrel 301 along with a spring package 310 and preloading means 320, 340 for preloading the sealing element. The mandrel 301 comprises an internally threaded female section near its lower end. A male section 302 comprises corresponding external threading near its upper end, and is threaded to the said female part. A retaining sleeve 351 for the anchor 350, the slide bearings 353, 354 for the anchor 350, the spring package 352 for preloading the slide bearings and the gripping element of the anchor 350 is disposed around the male part 302.

It is to be understood that the elements denoted 'leadscrew' and 'leadscrew nut' is provided to convert torque from a running tool (not shown) to radial force from gripping members and seals towards the wall of the casing, and that they may be given other designs.

In particular, it is noted that it sometimes may be required or advantageous to place, perhaps also in or near the section denoted by 300 in FIG. 1, pressure or temperature sensors, cameras, (infrared) light sources, ultrasound sensors, inductive sensors or other equipment for measurements. For instance, it may be advantageous to monitor the pressure behind a closed plug before it is opened or removed. It may also be advantageous to provide sensors for detecting areas of scaling or corrosion in the casing prior to setting the plug to ensure that proper sealing can be achieved. Inclusion of such equipment will be obvious to a person skilled in the art. For the sake of clarity, sensors and other similar equipment is thus not shown on FIG. 1.

Figure 2:
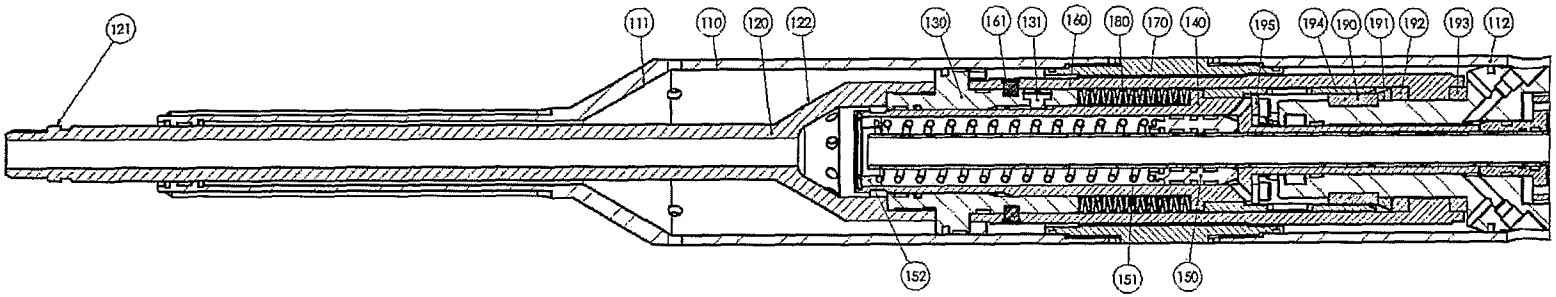
FIG. 2 is a cross section of a force transmitting section 100 shown in FIG. 1.

FIG. 2 is a detailed view of the force transmitting section 100. A rotatable shaft 120 can be rotated by a running or setting tool (not shown) acting on the upper end 121 of the shaft 120. A first external shell part 110 has an upper part through which the shaft 120 is inserted, and widens over an inclined inner surface 111 in the axial down direction, i.e. away from the end 121. The shaft 120 has a corresponding external inclined surface 122, which will engage the surface 111 during emergency retrieval, when a fishing tool pulls upwards in the end 121, i.e. towards the left in FIGS. 1 and 2.

The first external shell part 110 is threaded to a leadscrew nut 170, which in turn is threaded to a second external shell part 112. The leadscrew nut 170 is thus an integral part of the external shell of the well plug, and is manufactured with internal threads for a leadscrew.

The rotatable shaft 120 is at its lower end fastened to a sleeve 130, adapted to rotate in sleeve bearings retained on the inner wall of the first external shell part 110. The sleeve 130 and a leadscrew 160 is adapted to each other, such that the sleeve 130 can be rotated over an angle of free motion, typically 90-150°, before it engages and starts rotating the leadscrew 160. Within this angle of free motion, an activating sleeve 220 may be turned for opening or closing a ball valve without affecting the leadscrew 160. The ball valve and activating sleeve are described in greater detail below.

Furthermore, the sleeve 130 is connected to the inner surface of the leadscrew 160 only through radially extending shear pins 161. These shear pins can be broken by a blow applied by a fishing tool (not shown) in case of an emergency retrieval of the well plug. When the shear pins are broken, the sleeve 130 can be pulled out from the interior of the leadscrew 160.

The lower end of the sleeve 130 comprises a seat for a package (180) of springs, the springs preloading a rotatable transmission shaft 140 towards the activating sleeve 220.

The transmission shaft 140 has a central bore along its entire length and a radially extending shoulder near its upper end (to the left on FIG. 2). This shoulder, a piston 150, a spring 151 and a lid 152 forms an expansion chamber to equalize the pressure in the oil around the parts of the plug and the hydrostatic pressure in the surroundings. Near the place where the diameter is reduced, there is provided an abutment 195 which, during emergency release, pulls a retaining sleeve 194 away from a split ring 190. When the split ring 190 falls apart, the radial force from the sealing element 330 and anchor 350 against the wall of the casing is removed, and the well plug may be pulled out.

Figure 3:
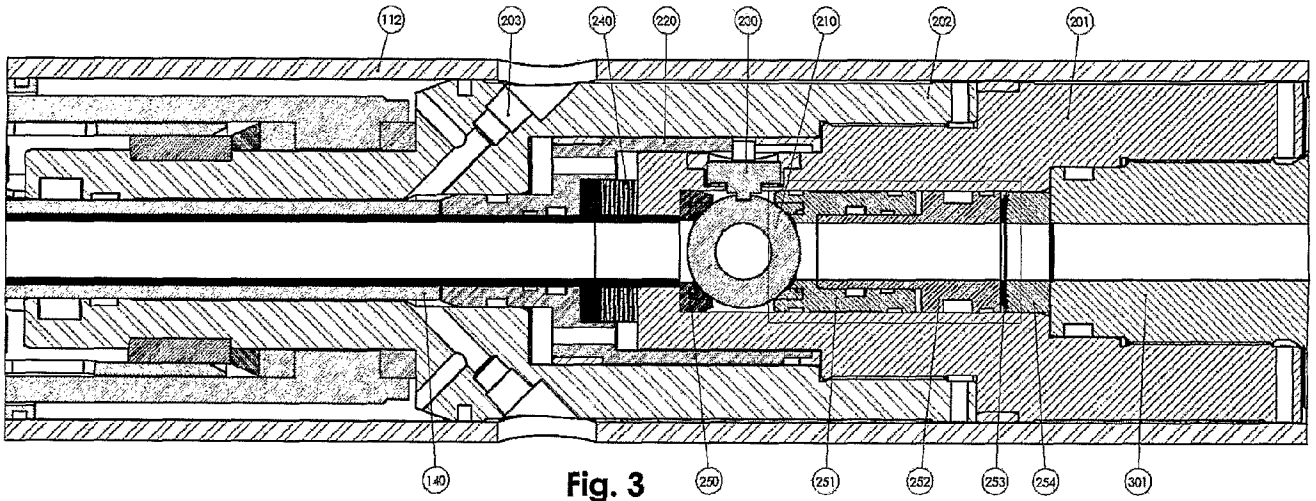
FIG. 3 is a cross section of a valve section 200 shown in FIG. 1.

FIG. 3 overlaps parts of FIG. 2, and shows an outer valve housing 202 disposed between the external shell 112 and the lesser external diameter of the rotatable transmission shaft 140. The outer valve housing 202 is the upper wall of the ball valve, it has external grooves for the said split ring 190, and is further provided with bores 203 for filling oil and letting out air. The lower end of the outer valve housing 202 is connected to the inner valve housing 201, the lower end of which is connected to the mandrel 301 discussed above in the description of FIG. 1.

Within a room formed by the inner 201 and outer 202 valve housings, there is an activating sleeve 220 able to rotate within a sector of a circle, for example 90-150°, corresponding to the angle of free motion between the sleeve 130 and leadscrew 160 discussed above. This rotation around the main axis of the activating sleeve opens and closes the ball valve, and ensures that the ball valve is open whenever the activating sleeve is rotated to one of its extreme positions. When the activating sleeve is rotated to one of its extreme positions, a further rotation of the transmission shaft 140, which is preloaded by a spring force against the activating sleeve 220 through a slip clutch, is still possible without further rotating the activating sleeve 220.

In the case of an emergency retrieval of the well plug, a preloaded spring package 240 will push the activating sleeve axially away from the inner valve housing, thereby turning an activating element 230 around an axis perpendicular to the main axis of the well plug, such that a valve ball 210 opens for fluid flow through the longitudinal, straight central passage through the well plug. It should be understood that the aim, to ensure that the valve is open during emergency release, may be achieved in other ways than using the activating sleeve 220 as pulling element for the eccentric pin 231. In other embodiments, in which e.g. an activating sleeve as describes above is not provided, a similar effect is obtained as long as one element pulls an eccentric point similar to the eccentric pin 231 towards the main axis, so that the valve ball 210 turns.

The purpose of the package of springs is to provide such a movement during emergency release.

The valve ball 210 is pressed towards a valve seat 250 disposed within the inner valve housing 201 by a piston assembly comprising an outer valve piston sleeve 251 and an inner valve piston sleeve 252. A spring package, e.g. washer 254 and a Belleville spring 253 disposed between the inner valve piston sleeve 252 and the mandrel, forces the valve ball 210 against the valve seat 250 with a minimum preload.

FIGS. 4*a* and 4*b* shows the activating sleeve 220 in perspective views from two different angles. The activating sleeve 220 is comprises a track 221 having ends 221*a*, 221*b* axially closer to a clutch disk 222 adapted for torque coupling to the transmission shaft 140. Other embodiments of an end part similar to 222 adapted to some other kind of torque coupling will be capable of working equally well.

FIG. 5 shows the activating member 230. An eccentrically displaced pin 231 is adapted to slide in the track 221 in the activating sleeve discussed above. When the activating sleeve is rotated around the main axis, the axially displaced parts of the cam track 220, i.e the parts near the ends 221*a*, 221*b* of the track, and the pin 231 travelling in them rotate the activating member 230. The lug 232 is inserted in a mating groove in the valve ball 210, and the valve ball consequently 210 turns about an axis perpendicular to the main axis of the activating sleeve 220.

FIG. 6 shows a detail from FIG. 3. The outer valve piston sleeve 251 is slideably, but not pressure tight, mounted in the inner valve piston sleeve 252. When the pressure is larger on the left hand side of the valve, the outer valve piston sleeve 251 will be moved towards the valve ball 210, i.e. to the left of FIG. 6, because D2 is larger than D1. When the pressure is larger on the right hand side of the valve, the piston will also be moved towards the ball, i.e. to the left of FIG. 6 because D3 is larger than D2. The ball valve thus comprises very few, relatively large and relatively uncomplicated movable parts, which contributes to making the valve robust and reliable in high-pressure applications.

The seals in FIG. 6 are perhaps better viewed in FIG. 9, which shows the valve of FIG. 6 with seals and slide bearings. In FIG. 9, it should be clear that there is a fluid communication from the valve ball 210 to the lower (rightmost) end of the piston 251. Same pressure, but larger annular area on the right hand side implies a force from right to left from piston 251 to the ball. We assume that the ball seals at the ring with diameter D2).

The necessary sealing elements of the ball valve may be metal to metal seals, or seals manufactured by an elastomer, having properties well known to a person skilled in the art.

FIG. 7 shows a second preferred embodiment of the activating sleeve 220 having a track 221 extending axially. The track 221 may advantageously also define the angle of free motion discussed above. It is further advantageous if the peg travelling in the track 220 are the same element as the shear pin 161 described above, i.e. that a shear pin 161 travel in the track 220 in the embodiment shown in FIG. 7. FIG. 7 also shows part of a second track 223, illustrating that the shear pins may travel in separate tracks.

FIG. 8 is a perspective view of an alternative embodiment of the valve operating mechanism. In this embodiment, slide bearing 260 rotates in a recess in the shaft 261. The sleeve 220 of FIG. 7 is shown with a shear pin 161 in the track 221. Due to the axially extending ends of the track 221, the shaft 261 will move axially a distance equal to the displacement of the ends 221*a* and 221*b*. An axial pitch rack engaging he cogs of a gear 230 turns the valve. It is readily seen that the gear 230 has is turning about a central turning axis, and has the same function as the activating member 230 in FIG. 5, and that a cog on the cogwheel provides an eccentric point 231 in a similar manner as the peg 231 on FIG. 5.

The description above regards a few embodiments of the invention, and modifications of it will be apparent for a person skilled in the art. The invention is hence as defined in the appended claims.

The invention claimed is:

1. A well plug for use in a wellbore, the well plug comprising:

a ball valve disposed in a central straight passage along a main axis of rotation of the well plug, a flexible expandable seal and a metallic gripping member operable by rotating a hollow leadscrew around the main axis and relative to an outer housing, a transmission shaft rotatable about the main axis and having a through axial bore forming part of the passage, wherein the transmission shaft and the leadscrew are connected by at least one peg on one of them slidably inserted in at least one groove in the other, the groove extending perpendicular to the main axis along a circumference and defining an angle of free motion wherein the transmission shaft can be rotated relative to the leadscrew, the at least one peg is slidably inserted in at least one cam track on an activating sleeve, the cam track comprising a middle part extending perpendicular to the main axis along part of the circumference of the activating sleeve and two ends at an axial distance from the middle part, and the activating sleeve is connected to a ball of the ball valve through means for converting axial movement of the activating sleeve to rotation of the ball, wherein the ball valve is open when the at least one peg is near an end of the at least one cam track and closed when the at least one peg is near the middle part of the at least one cam track.

2. The well plug according to claim 1, further comprising a slip clutch disposed between the transmission shaft and the activating sleeve in the ball valve, the ball valve being fixed relative to the outer housing, whereby the ball valve is kept open when the leadscrew rotates relative to the outer housing.

3. The well plug according to claim 1, wherein the well plug is filled with oil communicating with ambient pressure by means of an expansion chamber.

4. The well plug according to claim 1, wherein the at least one peg is a shear pin which may be broken by a blow from a fishing tool during emergency retrieval, whereby a radial force from the flexible expandable sealing and gripping element is substantially reduced and the plug may be withdrawn along the main axis by means of the fishing tool.

5. The well plug according to claim 4, wherein an axial pulling movement from the fishing tool causes the activating sleeve to keep the ball valve open during emergency retrieval.

6. The well plug according to claim 4, wherein the activating sleeve is axially preloaded with a spring package, which opens the ball valve once the shear pin is broken during emergency retrieval.

7. The well plug according to claim 1, being provided with at least one device from the group comprising pressure sensors, temperature sensors, cameras, lightsources for cameras, ultrasound equipment, induction meters and/or other measuring tools.

8. The well plug according to claim 1, wherein the ball valve comprises:

a valve seat disposed rotationally symmetric about the main axis, and fixed in an inner valve housing; and a hollow piston assembly axially movable within the inner valve housing and preloaded by a spring package towards a ball the ball disposed between a fixed valve seat and the piston assembly, wherein the piston assembly comprises an outer valve piston sleeve engaging the ball at a ball contact diameter and having an outer diameter greater than the ball contact diameter, the outer valve piston sleeve further comprises an inner cylindrical face with a diameter less than the ball contact diameter engaging a corresponding outer cylindrical face on an inner valve piston sleeve, the outer valve piston sleeve being axially movable on the inner valve piston sleeve and sealed against the inner valve piston sleeve at the cylindrical face between them, the ball valve provides fluid communication around the outer valve piston sleeve from an end contacting the ball to an annular face at the opposite end of the outer valve piston sleeve, the annular face being further defined by the outer diameter of the outer valve piston sleeve and the inner diameter contacting the inner valve piston sleeve, and the inner valve piston further seals against the inner valve housing, whereby a differential pressure along the main axis provides an increased force from the annular face through the outer valve piston sleeve on the ball at the ball contact diameter regardless of a direction of the differential pressure along the main axis when the ball is rotated to prevent fluid flow along the main axis.

9. The well plug according to claim 1, wherein the ball is connected to an activating element rotatable about a turning axis of the ball and having an eccentric peg displaced from the turning axis of the ball, the eccentric peg being slidably inserted in the cam track of the activating sleeve, whereby rotation of the activating sleeve causes the eccentric peg to travel axially in the cam track, thereby rotating the ball.

10. The well plug according to claim 1, wherein the ball is connected to a gear having cogs which engage cogs of an axial pitch rack, whereby rotation of the activating sleeve causes the pitch rack to move axially, turning the gear and hence the ball.

* * * * *